United States Patent [19]

Yaeger et al.

[11] 4,226,606

[45] Oct. 7, 1980

[54] WASTE HEAT RECOVERY SYSTEM

[75] Inventors: Ronald J. Yaeger; Gerald W. Keller, both of Dallas, Tex.

[73] Assignee: Air & Refrigeration Corp., Irving, Tex.

[21] Appl. No.: 949,084

[22] Filed: Oct. 6, 1978

[51] Int. Cl.[2] ..... F25B 27/02; F25B 13/00

[52] U.S. Cl. ..... 62/238; 62/324

[58] Field of Search ..... 62/117, 298, 299, 238 E, 62/324 D

[56] References Cited

U.S. PATENT DOCUMENTS

| | | | |
|---|---|---|---|
| 1,874,803 | 8/1932 | Reed | 62/238 E |
| 2,143,287 | 1/1939 | Smith . | |
| 2,530,648 | 11/1950 | Cahenzli et al. | 62/514 |
| 2,690,649 | 10/1954 | Borgerd | 62/238 E |
| 3,301,002 | 1/1967 | McGrath | 62/238 E |
| 3,916,638 | 11/1975 | Schmidt | 62/238 E |
| 3,922,876 | 12/1975 | Wetherington et al. | 62/180 |
| 4,041,726 | 8/1977 | Mueller et al. | 62/238 |
| 4,089,667 | 5/1978 | Jonsson | 62/238 E |
| 4,098,092 | 7/1978 | Singh | 62/238 E |
| 4,103,510 | 8/1978 | Hall | 62/299 |

*Primary Examiner*—Lloyd L. King
*Attorney, Agent, or Firm*—Kenneth R. Glaser

[57] ABSTRACT

A waste heat recovery system for use with refrigeration means and a hot water reservoir is disclosed. The system is intended for use with refrigeration means of the type including a compressor and a condenser through which a compressible refrigerant is circulated. The system includes a heat exchanger having a refrigerant passage and a water passage mutually coupled in heat exchange relation. A heat exchange circulation conduit connects the water passage of the heat exchanger in fluid communication with the hot water reservoir to permit water to be circulated from the reservoir to the heat exchanger and return. A fluid flow restrictor is connected in series fluid circuit relation intermediate the compressor discharge outlet and the condenser for producing a pressure differential. The refrigerant passage of the heat exchanger is connected in parallel fluid circuit relation with the fluid flow restrictor. The pressure differential created by the fluid flow restrictor causes flow of high pressure heated refrigerant vapor through the refrigerant passage for heat exchange purposes. The degree of restriction can be changed to divert more or less of the flow of the high pressure refrigerant vapor through the heat recovery system, thereby permitting a relatively small waste heat recovery system having a high fluid flow impedance to be used in combination with a large refrigeration compressor.

7 Claims, 2 Drawing Figures

WASTE HEAT RECOVERY SYSTEM

BACKGROUND OF THE INVENTION

1. Field of the Invention

The present invention relates to heat recovery systems, and in particular relates to such systems which recover the waste heat of air conditioning and refrigeration systems for purposes of heating water.

2. Description of the Prior Art

Because of the rapidly rising costs of energy, the incentives to conserve energy are increasing, both for industrial users and domestic users. Consequently there is currently considerable interest in not only eliminating energy waste by making equipment more efficient, but also by recovering energy such as waste heat which, according to conventional practice, is usually injected into the atmosphere without recovery.

It is well known in the art to use some of the heat from the condensing process of a refrigeration system to produce hot water in a storage tank. Heat is reclaimed by installing a heat exchanger in the hot gas line between the compressor and the condenser of the air conditioning system. Water from the bottom of the hot water heater tank is circulated through the heat exchanger by means of a small circulating pump. This basic arrangement has been used with success and is gaining widespread acceptance; but there is continuing interest in improving this basic system to make it more efficient and responsive.

The potential for energy conservation by the recovery of waste heat in the home and in industrial applications is substantial because of the amount of energy required to operate air conditioning equipment and hot water heating equipment, both of which are significant users of energy. For example, an air conditioning system with a water cooled condenser, while producing a ton of refrigeration or 12,000 BTUH of cooling capacity, also produces approximately 15,000 BTUH of heat which is rejected to the atmosphere. An air conditioning system with an air cooling condenser rejects about 16,000 to 17,000 BTUH for each ton or 12,000 BTUH of cooling capacity. Of this 15,000 to 17,000 BTUH of heat for each ton of capacity, 3,000 to 5,000 BTUH is relatively easy to recover at a very nominal expense. Generally, the refrigeration system is operated totally separate from the hot water system with the result that the heat removed from the condensing process is wasted, while the water in the hot water system is heated by means of an auxiliary energy source such as gas, electricity, or oil. The cost of such fuel or energy can be great particularly in situations where large amounts of hot water are required.

In industrial applications, many large refrigeration compressors are used in freezing, refrigerating or air conditioning. The recoverable heat associated with the hot refrigerant gases produced by the refrigeration compressors may be utilized in connection with an ongoing industrial process. However, most industrial installations can use some of the heat in the form of hot water. Because of the large volume of refrigerant flowing in industrial refrigeration compressor systems, and the necessarily large size refrigerant lines required, the conventional in-the-line (series) heat exchanger cannot be used for heat exchange purposes because of the detrimental effect of its large fluid flow resistance which causes an unacceptable pressure drop in the system. On the other hand, a heat exchanger connected in parallel with the refrigerant line would have a higher resistance to flow than the refrigerant line and therefore an insufficient volume of refrigerant gas would pass through the heat exchanger for heat exchange purposes. Accordingly, it is desirable to provide a waste heat recovery system in which a predetermined fraction of the high pressure heated refrigerant vapor flow can be diverted through the refrigerant passage of a heat exchanger for heat exchange purposes without interfering with operation of the compressor system.

SUMMARY OF THE INVENTION

It is, therefore, a principal object of the present invention to provide a waste heat recovery system which can be utilized with an existing refrigeration or air conditioning system having a relatively large capacity compressor through which large volumes of refrigerant gas are circulated to a condenser at a relatively large flow rate in which the insertion of an in-the-line series connected heat exchanger would be unacceptable because of the resulting pressure drop.

The foregoing objects and advantages are carried out according to the present invention in a waste heat recovery system for use with a refrigeration system or air conditioning system having a compressor thermally coupled to a hot water reservoir such as a conventional hot water heater. The waste heat recovery system includes a heat exchanger having a refrigerant passage and a water passage mutually coupled in heat exchange relation. A heat exchange circulation conduit connects the heat exchange water passage of the heat exchanger in fluid communication with the hot water reservoir to permit water to be circulated from the reservoir through the heat exchanger and return. A fluid flow restrictor is connected in series fluid circuit relation intermediate the compressor discharge outlet and the condenser for producing a pressure differential. The refrigerant passage of the heat exchanger is connected in parallel fluid circuit relation with the fluid flow restrictor. The pressure differential produced by the flow of refrigerant through the flow restrictor causes a predetermined fraction of the total flow to be diverted through the refrigerant passage of the heat exchanger for heat exchange purposes. The relative amount of refrigerant which is diverted through the refrigerant passage is determined by the relative magnitudes of the respective fluid flow impedances presented by the fluid flow restrictor and by the refrigerant flow passage. According to this arrangement, only as much refrigerant is diverted through the refrigerant passage of the heat exchanger as is needed for producing the desired amount of hot water. Therefore a predetermined fraction of the refrigerant flow may be diverted from a relatively large capacity compressor for heat exchange purposes without introducing an unacceptable pressure drop in the refrigeration system.

The foregoing and other objects, advantages and features of the invention will hereinafter appear, and for purposes of illustration, but not of limitation, an exemplary embodiment of the subject invention is shown in the appended drawing.

DETAILED DESCRIPTION OF A PREFERRED EMBODIMENT

Figure 1:
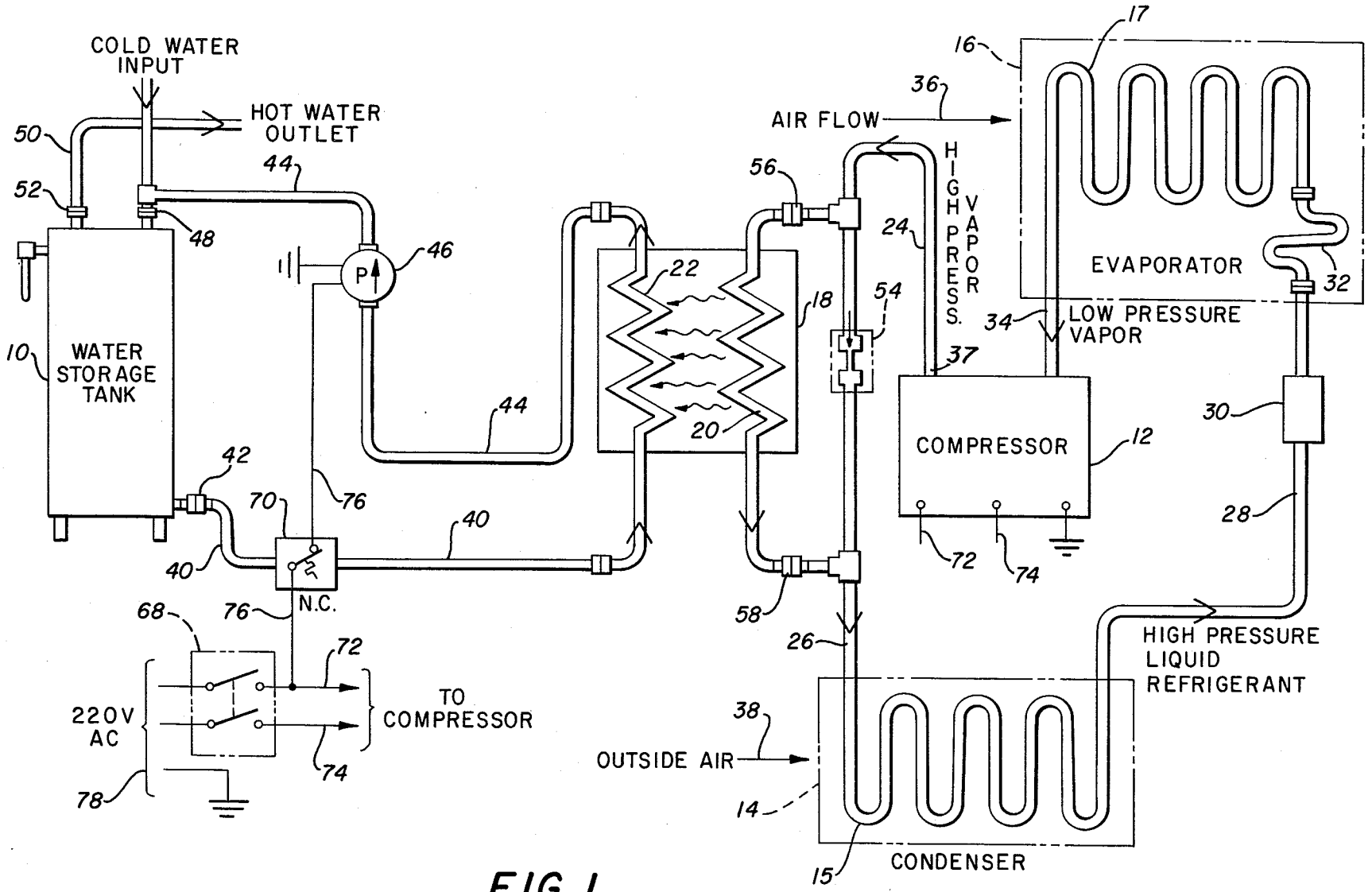
FIG. 1 is a schematic diagram of a waste heat transfer system constructed according to the teachings of the invention; and, FIG. 2 is a perspective view of the heat exchanger and calibrated flow restrictor assembly of the invention.

In the description which follows, like parts are marked throughout the specification and drawing with the same reference numerals, respectively.

Referring now to FIG. 1 of the drawing, the waste heat transfer system of the invention includes a hot water reservoir 10 which may be of any conventional size, for example, a forty gallon hot water tank as commonly found in a residence, or a substantially larger hot water reservoir as may be commonly found in a commercial establishment, and an air conditioning or refrigeration system which includes a compressor 12, a condenser 14 and an evaporator 16. The compressor 12, condenser 14 and evaporator 16 are suitably interconnected to provide air conditioning or refrigeration for a residence or for a commercial establishment. Although the principles of operation are the same for either case, the invention will be described for a commercial application in which a relatively large compressor having a relatively large diameter refrigerant discharge line is utilized for refrigerating food storage areas, for example a meat cooler, a display case or a grocery refrigerator which are commonly found in a cafeteria operation which also includes a large hot water reservoir for providing hot water for the cafeteria operation. Air to be conditioned within the refrigeration areas is brought into heat exchange relation with the evaporator 16 by means of suitable circulation equipment (not shown) into the area being conditioned. An outside fan (not shown) brings outdoor air into heat exchange relation with the condenser 14.

The hot water tank 10 and the refrigeration system are thermally coupled by means of a heat exchanger 18 which includes a refrigerant passage 20 and a water passage 22 which are mutually coupled in heat exchange relation. A suitable refrigerant is circulated through the refrigerant passage 20 and is discharged into the condenser 14 through a condenser inlet conduit 26. The condenser 14 is connected in series fluid circuit relation with the evaporator 16 by means of a high pressure liquid refrigerant line 28. Prior to entering the evaporator 16, the refrigerant passes through a combination filter and dryer unit 30 which is connected in series fluid circuit communication with either a capillary tube or an expansion valve 32 according to conventional practice. Refrigerant is circulated through the evaporator and is discharged through a low pressure vapor suction line 34 where it enters the inlet port 35 of the compressor 12.

In operation, liquid refrigerant flows from the condenser 14 up through the high pressure liquid refrigerant line 28 to the combination filter/dryer 30. From the filter/dryer, the refrigerant flows through the capillary tube 32 into the evaporator 16. The pressure of the liquid refrigerant as it enters the capillary tube at the filter end is at a high pressure, while the pressure in the evaporator 16 is at a low pressure. The design of the capillary tube 32 is such that it maintains a pressure difference while the compressor 12 is operating. The compressor maintains a low pressure in the evaporator coil 17, and the refrigerant boils rapidly thereby absorbing heat from the evaporator coils as air passes in heat transfer relation with the evaporator coils as indicated by the arrow 36. The vaporized refrigerant is drawn through the suction line 34 back to the inlet port 35 of the compressor 12 where it is compressed to a high pressure and is subsequently discharged through the outlet port 37 into the condenser coil 15 where it is cooled by the flow of outside air as indicated by the arrow 38 and returns to a liquid. Thus the liquid refrigerant absorbs heat while changing from its liquid state to a vapor state in the evaporator and gives up heat in changing from a vapor to a liquid in the condenser.

A heat exchange circulation circuit 40 connects the water passage 22 of the heat exchanger 18 in series fluid circuit relation with the water storage tank 10. One end of the heat exchange circulation conduit 40 is coupled to the water storage tank 10 at a drain coupling 42 and the opposite end is connected to a coupling member 41 of the water passage 22. Water flows from the water storage tank 10 through the conduit and through the water passage 22 in counterflow relation with respect to the flow of refrigerant through the refrigerant passage 20. The opposite end of the passage 22 is coupled to a return conduit 44 in which a pump 46 is connected in series fluid circuit relation for effecting the circulation of water from the water storage tank 10 through the water passage 22 of the heat exchanger 18. One end of the return conduit 44 is connected to the coupling member 43 of the water passage 22 and the opposite end is coupled to the tank 10, preferably to the cold water inlet port 48 of the water storage tank 10. According to this arrangement, water in the storage tank 10 is thermally stratified with relatively cold water being withdrawn through the drain coupling 42 and is thereafter heated as it is circulated through the water passage 22 of the heat exchanger and then is discharged into the top of the water storage tank. The pump 46 is preferably water lubricated having a suitable fractional horsepower rating and a power requirement of 110 volts AC.

A hot water distribution conduit 50 is coupled to the hot water outlet port 52 of the water storage tank 10 for supplying hot water to a remote station (not shown) within the commercial establishment which may include a number of hot water faucets or which may include a hot water reservoir beneath the food trays of a hot food serving line in a cafeteria, for example.

Figure 2:
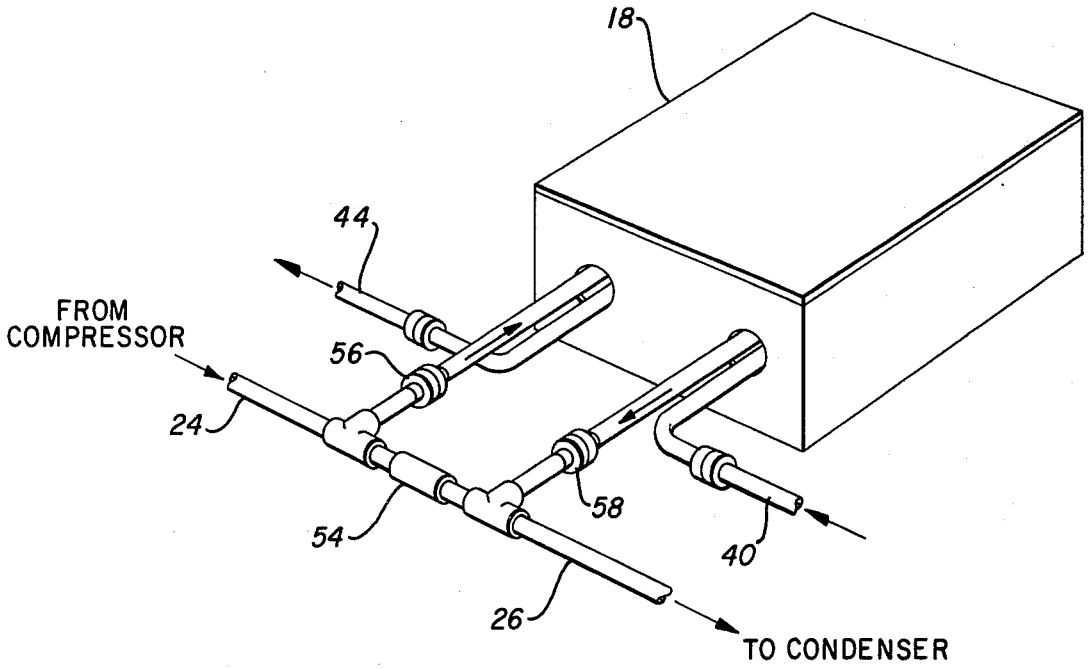

The heat exchanger 18 is not connected directly into the high pressure refrigerant discharge conduit 24 because of the very large flow impedance presented by the refrigerant passage 20 which would upset the pressure balance of the refrigeration system. According to the invention, the refrigerant is discharged through the outlet port 37 and into the high pressure refrigerant conduit 24 through a fluid flow restrictor 54 which is connected in series fluid circuit relation intermediate the compressor discharge outlet port 37 and the condenser inlet port 26. The fluid flow restrictor 54 may be any suitable flow restricting device such as an orifice plate or a venturi tube having a calibrated opening for producing a predetermined pressure drop. The refrigerant passage 20 is connected in parallel fluid circuit relation with the fluid flow restrictor 54 by means of a pair of quick connector coupling assemblies 56, 58. This parallel connection of the calibrated flow restrictor 54 with the heat exchanger 18 is illustrated in greater detail in FIG. 2 of the drawing.

The heat exchanger 18 is preferably of the counterflow type for maximum heat transfer. The coaxial or tube-in-tube heat exchanger has proven very satisfactory. This type of heat exchanger consists of one or more assemblies of two tubes, one within the other, in which the hot gas refrigerant is conveyed through the outer tube with water flowing through the inner tube. These heat exchangers are sold commercially as water cooled refrigerant condensers by a number of refrigerant supply houses. Manufacturers and suppliers of the tube-in-tube condensers and model numbers commonly available are Edwards Engineering Corporation, Model "S", Halstead Mitchell Company Series E.L., and Dunham Bush Series CICB.

Because of the very large amount of waste heat available which can be recovered from the air conditioning process, the heat exchanger 18 need only be sized with a BTU rating which will effectively remove the superheat from the high pressure refrigerant vapor with substantially all of the condensation taking place within the condenser 14. According to this arrangement, the high pressure refrigerant vapor discharged from the refrigerant passage 20 of the heat exchanger into the condenser is preferably substantially at its boiling point as it enters the condenser. The advantage of this arrangement is that since a more than adequate supply of heat energy is available for heating the water, it can be connected within an existing air conditioning or refrigeration system for removing only the superheat without disturbing the pressure balances within the system. Because of the parallel connection of the refrigerant passage 20 with the fluid flow restrictor 54, the heat exchanger can be utilized in combination with relatively large high pressure refrigerant discharge lines associated with large compressors which are typically found in commercial establishments, without interfering with the pressure balance of the refrigeration system.

Because more heat may be recovered than can typically be utilized in the average residence or in some commercial applications, it is desirable to decouple the hot water circulation system from the refrigeration system when an adequate supply of hot water at a desired temperature is available in the water storage tank 10. This function is carried out by energizing and de-energizing the pump 46 in response to the temperature of the water drawn from tank 10. Specifically, a temperature sensitive switch 70 is thermally coupled to water drawn from the drain connection 42 and is electrically coupled to the pump 46 and to the power circuit 78 for energizing the pump 46 when the compressor 12 is energized and the temperature of the water being drawn from the water storage tank 10 is less than a predetermined level, for example 160° F., and for de-energizing the pump 46 when the temperature of the water drawn from the drain connection is at or exceeds this predetermined level. To carry out this function, the temperature sensitive switch 70 is normally closed and opens only when the temperature it senses exceeds the predetermined level. An example of a suitable temperature sensitive switch is ThermODisc No. 27276 by ThermODisc, Inc., which is a division of Emerson Electric Company.

With this arrangement, it will be seen that the temperature sensitive switch 70 will open to de-energize the pump 46 and thereby interrupt the flow of water through the heat exchanger when the temperature of the water circulating through the conduit 40 reaches a desired operating temperature thereby eliminating the possibility of exceeding the temperature and pressure limits of the hot water storage tank 10. It will be seen that the invention as described herein provides means for adapting a large refrigeration compressor to a small heat exchanger in which hot water is heated by recovering the super heat from the hot refrigerant gas. Inasmuch as large refrigeration compressors are used in freezing, refrigerating or air conditioning applications, the potential recoverable heat from the hot refrigerant gases is very great and most installations can use some of the heat in the form of hot water. However, because of the large volume of refrigerant flowing in commercial systems, and because of the necessarily large size of the refrigerant lines, conventional heat exchangers cannot be connected in series relation directly into the line without introducing an unacceptable pressure drop in the refrigeration system. However, the heat recovery system of the invention permits a predetermined fraction of the total refrigerant flow to be diverted through a heat exchanger for the production of hot water without upsetting the pressure balances of the refrigeration system and without redesigning the existing system. Although the invention has particular utility for use in combination with very large refrigeration systems as would be found in commercial applications, it also may be used with relatively smaller refrigeration systems such as an air conditioning system for a residence.

Although a preferred embodiment of the invention has been described in detail, it should be understood that various changes, substitutions and alterations can be made therein without departing from the spirit and scope of the invention as defined by the appended claims.

What is claimed is:

1. In a heat recovery system for recovering waste heat from refrigeration means to heat water supplied to a hot water reservoir wherein said refrigeration means includes a compressor having a discharge outlet for circulating a compressible refrigerant, and said heat recovery system comprises heat exchanger means having a refrigerant passage and a water passage mutually coupled in heat exchange relation, said refrigerant passage being connected in fluid communication with the discharge outlet of said compressor, and a conduit connecting said heat exchanger water passage in fluid communication with said reservoir to permit water to be circulated from said reservoir through said heat exchanger and return; the improvement comprising:

(a) a by-pass conduit connected in parallel fluid circuit relation with said refrigerant passage and having its inlet in fluid communication with the discharge outlet of said compressor, thereby enabling refrigerant exiting the discharge outlet of the compressor to flow through both the heat exchanger refrigerant passage and the by-pass conduit; and (b) a fluid flow restrictor disposed within said by-pass conduit, said restrictor effective to impede, but not prevent, refrigerant flow through said by-pass conduit.

2. The improvement as defined in claim 1, wherein said fluid flow restrictor has a calibrated opening presenting a fluid flow impedance to the flow of said refrigerant through said by-pass conduit which is substantially equal to the fluid flow impedance presented by said heat exchanger refrigerant passage.

3. The heat recovery system as defined in claim 1, said fluid flow restrictor being an orifice plate.

4. The heat recovery system as defined in claim 1, said fluid flow restrictor being a venturi tube.

5. A waste heat transfer system for use with refrigeration means and a hot water reservoir, said refrigeration means including a condenser and a compressor having a discharge outlet for circulating a compressible refrigerant through said condenser, said waste heat transfer system comprising, in combination:

a heat exchanger means having a refrigerant passage and a water passage mutually coupled in heat exchange relation, a heat exchange circulation conduit coupling said heat exchanger water passage in fluid communication with said reservoir to permit water to be circulated from said reservoir through said heat exchanger and return, a by-pass conduit connected in parallel fluid circuit relation with said refrigerant passage, said by-pass conduit having its inlet in fluid communication with the discharge outlet of said compressor and its outlet in fluid communication with the inlet to said condenser, thereby enabling refrigerant exiting the discharge outlet of the compressor to flow through both the heat exchanger refrigerant passage and the by-pass conduit to said condenser, and a fluid flow restrictor disposed within said by-pass conduit, said restrictor effective to impede, but not prevent, refrigerant flow through said by-pass conduit.

6. In combination a hot water reservoir;

a pump;

a heat exchanger having a refrigerant passage and a water passage mutually coupled in heat exchange relation;

a water circulation conduit coupled to said water reservoir connecting said pump and said water passage in series fluid circuit relation for circulating water from said reservoir through said heat exchanger and return;

refrigeration means including a condenser and a compressor having an outlet port for discharging a compressible refrigerant into said condenser;

conduit means connecting the refrigerant passage of said heat exchanger in series fluid circult relation intermediate the outlet port of said compressor and the inlet port of said condenser, a by-pass conduit connected in parallel fluid circuit relation with said refrigerant passage and having its inlet in fluid communication with the outlet port of said compressor and its outlet in fluid communication with the inlet port of said condenser, thereby enabling refrigerant exiting the outlet port of said compressor to flow through both the heat exchanger refrigerant passage and the by-pass conduit to the inlet port of said condenser, and fluid flow restricting means disposed within said by-pass conduit for impeding, but not preventing, refrigerant flow therein and for shunting a predetermined fraction of refrigerant discharged from said compressor directly into said condenser with the remainder of said refrigerant flowing to said condenser through said refrigerant passage.

7. In a waste heat recovery system for use with refrigeration means and a hot water reservoir, said refrigeration means including a condenser and a compressor having an outlet port through which superheated refrigerant is discharged, the improvement comprising:

a heat exchanger having a refrigerant passage and a water passage mutually coupled in heat exchange relation, said refrigerant passage being connected in series fluid circuit relation intermediate said compressor outlet port and said condenser, said water passage being coupled in fluid circulating relation with said hot water reservoir, and said heat exchanger being adapted for recovering substantially only the superheat energy associated with said superheated refrigerant whereby refrigerant discharged from said refrigerant passage is substantially at its boiling point as it enters said condenser, a by-pass conduit connected in parallel fluid circuit relation with said refrigerant passage, said by-pass conduit having its inlet in fluid communication with the outlet port of said compressor and its outlet in fluid communication with the inlet to said condenser, thereby enabling said superheated refrigerant to flow through both the refrigerant passage and the by-pass conduit, and fluid flow restricting means disposed within said by-pass conduit for impeding, but not preventing, refrigerant flow therethrough and for producing a predetermined pressure differential between said compressor outlet and said condenser, thereby inducing the flow of a predetermined fraction of said superheated refrigerant through the refrigerant passage of said heat exchanger.

* * * * *

UNITED STATES PATENT AND TRADEMARK OFFICE

CERTIFICATE OF CORRECTION

PATENT NO. : 4,226,606

DATED : Oct. 7, 1980

INVENTOR(S) : Ronald J. Yaeger; Gerald W. Keller

It is certified that error appears in the above-identified patent and that said Letters Patent are hereby corrected as shown below:

Col. 3, Line 12 "hot water tank" should read -- hot water heater tank --

Col. 4, Line 10 "circuit" should read -- conduit --

Col. 7, Line 39 "circult" should read -- circuit --

Signed and Sealed this

*Third* Day of *February 1981*

[SEAL]

*Attest:*

RENE D. TEGTMEYER

*Attesting Officer*

*Acting Commissioner of Patents and Trademarks*